United States Patent [19]

Tahiliani

[11] 3,934,071

[45] Jan. 20, 1976

[54] AIR ENTRANCE BUSHING FOR GAS-INSULATED BUS

[75] Inventor: Vasu H. Tahiliani, New Stanton, Pa.

[73] Assignee: I-T-E Imperial Corporation, Spring House, Pa.

[22] Filed: Oct. 22, 1974

[21] Appl. No.: 516,995

[52] U.S. Cl. ..... 174/31 R; 174/19; 174/142

[51] Int. Cl.[2] ..... H01B 17/26; H02G 15/22

[58] Field of Search ..... 174/14 BH, 15 BH, 16 BH, 174/18, 19, 20, 28, 31 R, 73 R, 142

[56] References Cited

UNITED STATES PATENTS

| | | | |
|---|---|---|---|
| 3,643,003 | 2/1972 | Graybill | 174/18 |
| 3,813,475 | 5/1974 | Cronin | 174/28 X |
| 3,849,590 | 11/1974 | Ozawa et al. | 174/31 R |

FOREIGN PATENTS OR APPLICATIONS

| | | | |
|---|---|---|---|
| 21,135 | 9/1968 | Japan | 174/15 BH |
| 456,709 | 7/1968 | Switzerland | 174/31 R |

*Primary Examiner*—Laramie E. Askin

*Attorney, Agent, or Firm*—Ostrolenk, Faber, Gerb & Soffen

[57] ABSTRACT

An air entrance bushing for a gas-insulated bus utilizing a porcelain insulator shell which is small in diameter. The central bushing conductor of the insulator reduces in diameter as the porcelain insulator reduces in diameter toward the outer end of the bushing.

6 Claims, 3 Drawing Figures

32
35
31
37
80
38
30
36
50
51
75
39
76
92
77
40
54
23
53
55
52
60
61
63
62
70

51
91
90
31
32

AIR ENTRANCE BUSHING FOR GAS-INSULATED BUS

BACKGROUND OF THE INVENTION

This invention relates to an entrance bushing, and more specifically relates to the combination of an air entrance bushing and a gas-insulated bus wherein the largest inside diameter of the porcelain portion of the bushing approximately equals the diameter of the gas-insulated bus outer housing.

Gas-insulated transmission systems are well known wherein a high-voltage substation for dealing with voltages which may be of the order of 500,000 volts and higher have their principal components, such as circuit breakers, switches, and the like enclosed in gas-filled grounded metal enclosures which are connected to one another by elongated conductors which are also contained in an outer grounded enclosure filled with a compressed insulating gas such as sulfur hexafluoride.

It is necessary to provide an air entrance bushing to make the connection from an overhead line, for example, to the central gas-insulated conductor of the gas-insulated bus. At the present time, these bushings consist of an elongated porcelain body of tapering or straight diameter with suitable corona rings at the ends of the porcelain body to allow adequate flaring of the dielectric potential lines.

The large diameter end of the porcelain body is made larger than the outer diameter of the gas-insulated bus outer housing so that the gas-insulated bus outer grounded housing can penetrate into the interior of the bushing porcelain, with a corona ring provided at the end of the grounded outer housing to provide proper termination of the grounded bus within the porcelain body. The interior volume of the outer housing bus then communicates with the interior volume of the porcelain of the bushing so that the porcelain can be filled with gas under pressure to ensure good dielectric isolation between the bushing central conductor and its outer insulation components.

The cost of the porcelain portion of the air entrance bushing is generally proportional to the square of its largest diameter. Since prior art bushings require the outer housing of the gas-insulated bushing to enter the bushing, the bushing outer diameter is necessarily larger than the housing diameter, thus substantially setting a high minimum cost for the air entrance bushing. Moreover, the larger diameter needed for the bushing requires larger wall thicknesses for the porcelain in order to withstand pressure loading on the bushing from the high-pressure dielectric gas. This increased wall thickness further increases the cost of the bushing.

The presently used construction for the air entrance bushing of a gas-insulated bus also permits the inadvertent deposition of metal particles and other contamination products on the surfaces of the spacer insulators, thereby to reduce the electrical withstand level of the bus. It is extremely difficult to reduce the contamination level within the insulator bushing by preassembly of the bushing at the factory since transportation considerations require the assembly of the device in the field. Thus, contamination problems within the air entrance bushing of a gas-insulated system are increased.

BRIEF SUMMARY OF THE INVENTION

In accordance with the invention, a novel bushing construction is provided wherein the porcelain insulator portion of the bushing terminates in a metallic flange which is welded to a short, cylindrical section having a diameter equal to the diameter of the grounded housing of the bus which is to receive the bushing. Thus, the bus which is to be terminated can be connected to the bushing in the same manner that adjacent bus sections are connected to one another as disclosed, for example, in U.S. Pat. 3,813,475 in the name of John C. Cronin, entitled GROUNDED GAS INSULATED BUS ENCLOSURE-COMBINED ENCLOSURE JOINT BACKUP RING AND CONTAMINATION CONTROL DEVICE, and assigned to the assignee of the present invention.

The novel bushing construction is further provided with a conical insulator support and with an internal contamination particle trap which defines a low-field region which will trap any metal particles and the like which exist within the interior of the insulator bushing. Thus, the bushing can be mounted either vertically or horizontally or at any inbetween angle. If the bushing is installed vertically, contamination particles will fall into the bus area that has generous dielectric clearances. However, if the bushing is mounted horizontally, the particles will be trapped in the space having a low dielectric field.

Moreover, in accordance with the invention, the bushing conductor is an elongated bushing which is substantially freely supported between its opposite ends where the bushing has a limited or decreasing diameter. Thus, it is possible to design the bushing with high operating electrical stresses in this region since there is no solid insulator support in the region and virtually no possibility of contamination in the high electrical stress, reduced diameter area of the bushing. In addition, the central bus in this reduced-diameter portion area can also be reduced to better control the electrostatic field distribution within the bushing.

DETAILED DESCRIPTION OF THE DRAWINGS

Figure 1:
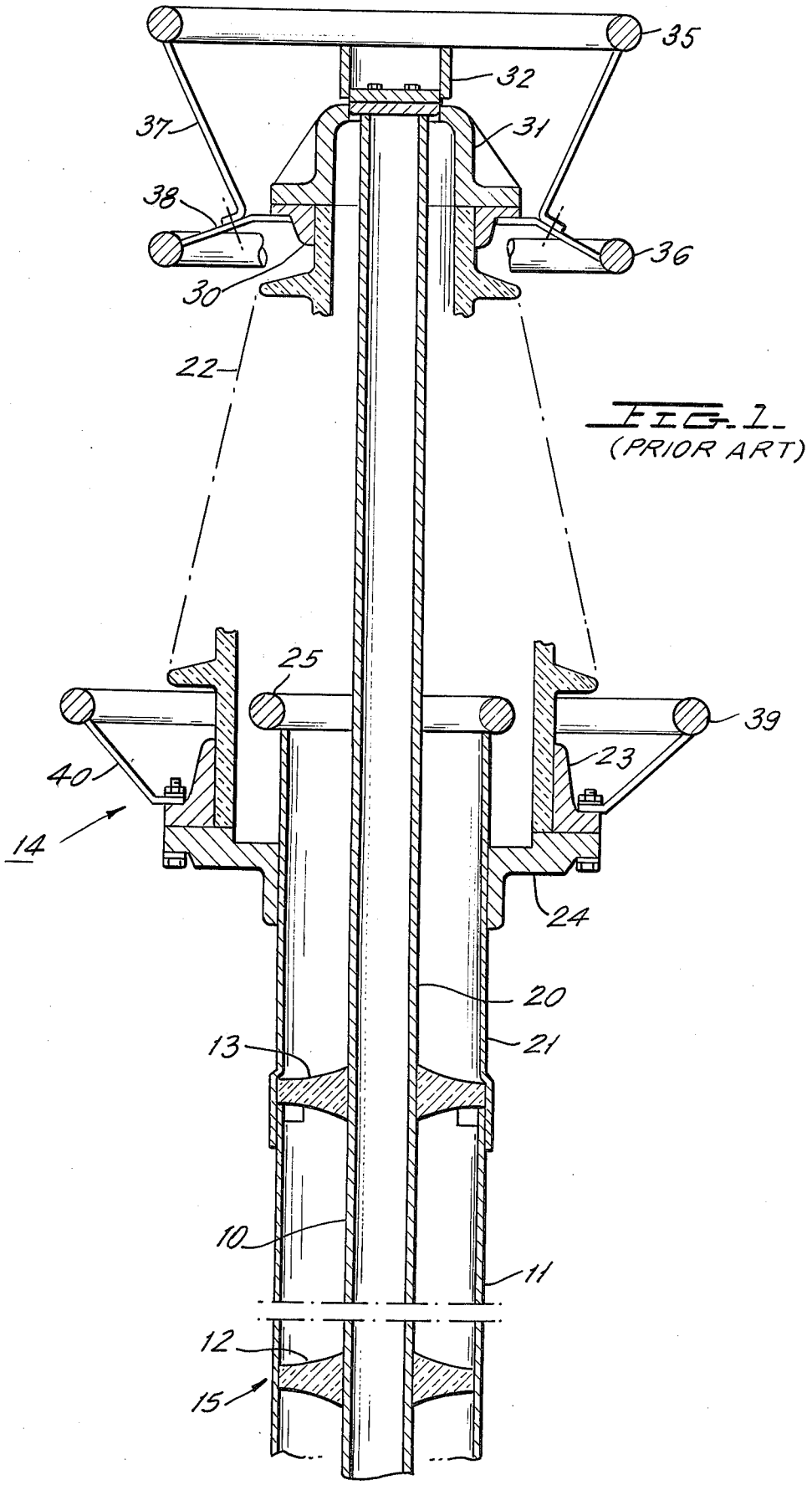
FIG. 1 (PRIOR ART)
FIG. 1 is a cross-sectional view through the axis of a prior art type air entrance bushing for a gas-insulated bus.

Referring first to FIG. 1, there is illustrated therein one end of a conventional gas-insulated bus 15 comprised of a central tubular conductor 10 which might have an outer diameter, for example, of five inches and which is supported within an outer grounded metallic housing 11 which could have a diameter, for example, of twelve inches. The central conductor 10 is supported within the outer housing 11 by a plurality of axially spaced support insulators, such as insulator disk 12 and the insulator disk 13 which terminates the air entrance bushing 14. The air entrance bushing 14 will have any desired configuration but typically will be vertically mounted to enable connection to overhead lines which are to be connected to the gas-insulated bus system 15. The interior of the gas-insulated bus 15 may be filled with gas, such as sulfur hexafluoride which could be at a pressure, for example, of 45 p.s.i.g.

The bushing 14 consists of the bushing conductor 20 which may be identical to conductor 10 of the gas-insulated bus 15, a cylindrical conductive grounded housing 21, which may be identical to housing 11, and a skirted elongated porcelain tubular jacket or shell 22, with its associated top and bottom hardware. The porcelain shell 22 is cemented to a metallic ring 23 which is bolted or otherwise secured to flange 24 which is, in turn, brazed or otherwise secured to cylindrical housing 21. The housing 21 penetrates into the large diameter end of porcelain jacket 22 and is terminated by a corona ring 25. Thus, in the prior art arrangement, the porcelain shell 22 had to have a large bottom diameter which was greater than the diameter of housing 21 so that the end of housing 21 could be received into porcelain shell 22 in the manner shown.

The upper hardware of the bushing 14 consists of a metallic ring 30 which is cemented to the upper end of porcelain shell 22 and an upper metallic cap 31 which is bolted or otherwise secured to the ring 30 and to the upper end of conductor 20. The upper cap 31 then has a terminal connector 32 bolted thereto for receiving the ends of the overhead lines which are to be connected to the bushing 14. Suitable corona rings 35 and 36 are connected to the cap 31 and thus to the upper end of central conductor 20 as by wire connectors 37 and 38. A bottom corona ring 39 is connected to conductive ring 23 and thus to ground as by support wires 40.

In the prior art construction described above, the bushing 14 is connected to the gas-insulated bus system 15 as by causing the end of cylindrical housing 21 to telescope over cylindrical housing 11 with a good seal being made at this point. This is a conventional method and construction for joining together bus sections similar to sections 15 when the gas-insulated system is installed in the field. Clearly, any other method of connection could be used. However, the diameter of housing 21 is fixed, thereby fixing the minimum diameter or the lower end of porcelain shell 22. Since the porcelain shell 22 must have a large diameter lower end, the cost of the bushing end becomes relatively large and, moreover, if increased gas pressure is to be used within the bushing 14, to compensate for the presence of contamination particles, the wall thickness of the porcelain 22 must be substantially increased.

Figures 2, 3:
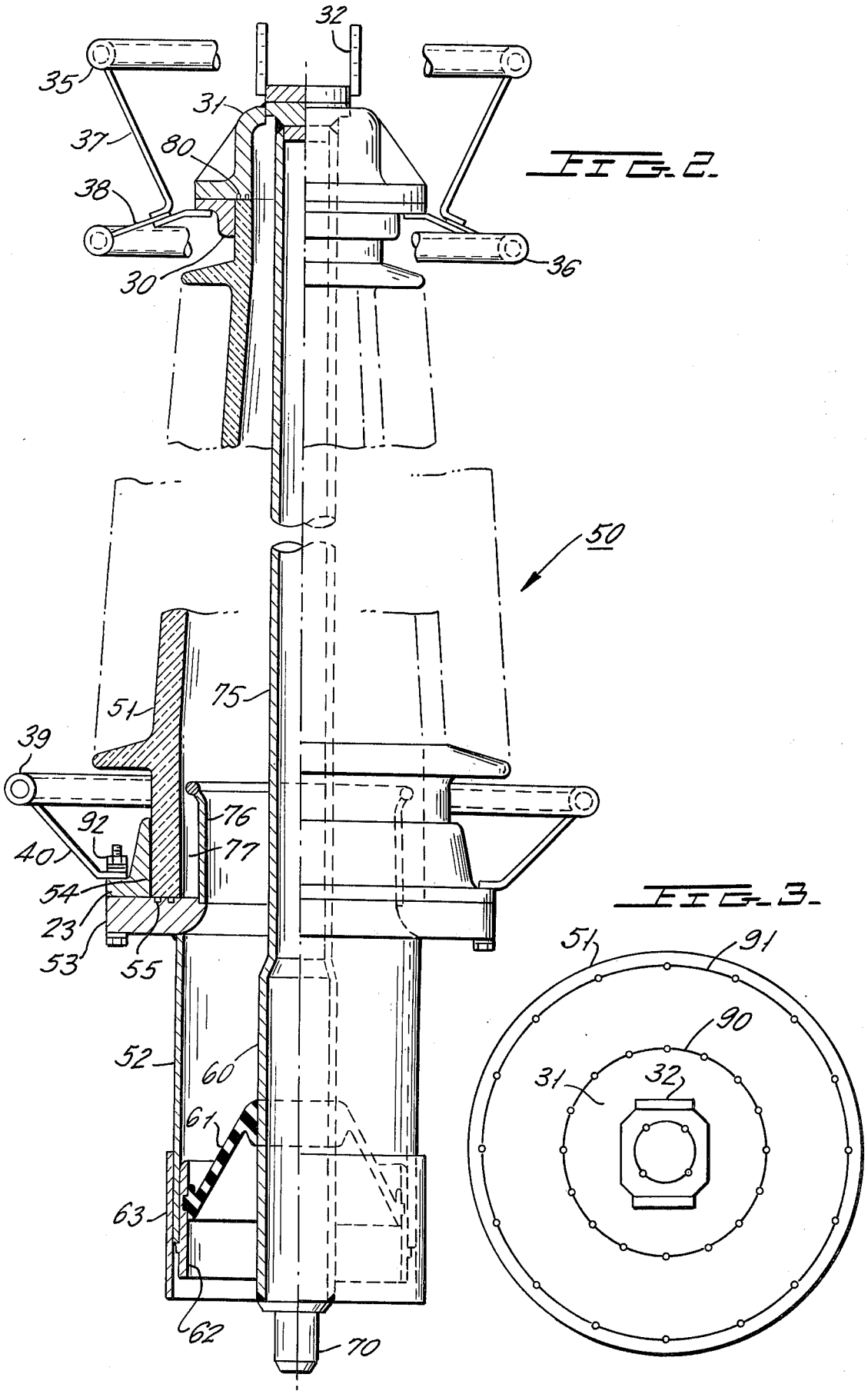
FIG. 2 is a partial cross-sectional view similar to FIG. 1 and illustrates the bushing of the present invention.
FIG. 3 is a top view of the bushing of FIG. 2 with the outer corona ring removed for purposes of clarity.

In accordance with the present invention, the bushing of FIG. 1 has been modified as shown in FIGS. 2 and 3 for the bushing 50. Referring now to FIGS. 2 and 3, the bushing 50 consists of a skirted porcelain jacket 51 which, for the same rating bushing as that of FIG. 1, will have a bottom diameter portion which is substantially equal to the outer diameter of the grounded housing to which the bushing is to be connected. Thus, in FIG. 2 a cylindrical grounded housing member 52, which corresponds to grounded housing section 21 of FIG. 1, is connected to a lower conductive flange 53 as by brazing or the like, and the flange 53 is in turn bolted or otherwise secured to ring 23 which is cemented by the cement layer 54 to the bottom of the porcelain 51. Note that suitable sealing rings, such as sealing ring 55, are provided between the bottom of procelain 51 and flange 53 to prevent the leakage of high-pressure gas from within the interior of porcelain 51 to the external atmosphere.

It is important to note that, in the configuration of FIG. 2, the lower diameter of porcelain member 51 is substantially equal to the outer diameter of the grounded housing 52. Thus, the cost of the bushing will now be substantially reduced since it is proportional to the square of this largest diameter portion of the bushing porcelain.

By way of example, for a given application, the large diameter of bushing 14 of FIG. 1 will be about 16.5 inches, while the bushing of the invention will have a diameter of 12.5 inches, while retaining the same electrical performance. This reduction in diameter can reduce the bushing cost by about 40%.

FIG. 2 shows a modified arrangement for the support of the central conductor 60 of the bushing (corresponding to conductor 20 in FIG. 1) wherein the conductor 60 receives a conical insulator 61 which extends between the lower portion of conductor 60 to a ring 62 which is secured to housing 52 and is backed by a backing ring 63. This configuration is the same configuration which is used in above-noted U.S. Pat. 3,813,475 and is extremely useful in terminating the bottom of the bushing 50 and to enable the connection of the bushing to the standard type of gas-insulated housing such as the bus 15 of FIG. 1. The central conductor 60 is then provided with a reduced contact diameter region 70 to enable the plug-in connection of the bus to the central conductor of the bus which is being terminated in a manner shown, for example, in copending application Ser. No. 501,152, filed Aug. 28, 1974, in the name of James C. Cron, entitled FLOATING CORONA SHIELD, and assigned to the assignee of the present invention.

In accordance with a further feature of the invention, the bus conductor 60 has a reduced diameter region 75 which begins just below the level of flange 53 in order to increase the spacing between the surface of the central conductor and the interior surface of the porcelain shell 51.

An internal cylindrical corona shield 76 is formed on the interior diameter of flange 53 and, in accordance with a feature of the invention, the shield 76 defines an annular particle trap region 77 which is a region of low-field intensity surrounding the interior bottom end of the porcelain shell 51.

The outer end of the bushing 50 is then terminated in a manner substantially identical to that described in connection with FIG. 1 where similar components in the upper termination of FIGS. 2 and 3 have been given similar identifying numerals. Note that, in the upper hardware construction, seals 80 are disposed between conductive ring 31 and the upper end of the porcelain jacket 51 to again seal the volume between conductor 60 and the porcelain housing 51.

FIG. 3 illustrates the general configuration of the bushing as seen from the top and shows the U-shaped arrangement for the upper terminal 32 and the locations of a first bolt ring 90 for the bolts which can connect conductive ring 31 to the conductive ring or flange 30 and also shows the bolt ring 91 of the bolts including bolt 92 for connecting ring 23 to the conductive flange 53.

As previously pointed out, the bushing of the present invention has a reduced largest diameter region and further provides a bushing which can be mounted either vertically or horizontally or in any angle between vertical and horizontal. When the bushing is vertically mounted, any contamination particles which fall into the bus area and toward insulator 61 will fall into the bus area which has the widest dielectric clearances. If, however, the bushing is mounted horizontally or at some angle to the vertical, any contamination particles will ultimately be trapped in the volume 77 of reduced diameter stress. Thus, increased pressures may be applied to the volume within porcelain 51 without fear of aggravating the contamination particle problem, and without excessive increases in the cost of the porcelain member 51.

Although there has been described a preferred embodiment of this invention, many variations and modifications will now be apparent to those skilled in the art. Therefore, this invention is to be limited, not by the specific disclosure herein, but only by the appended claims.

I claim:

1. In combination, an air entrance bushing and a gas-insulated electric power transmission bus; said gas-insulated bus comprising an elongated, gas-filled conductive grounded housing having a given diameter, an elongated central bus conductor, and support means supporting said elongated central bus conductor within said housing; said bushing comprising a generally vertically disposed hollow elongated gas-filled insulation shell, a conductive flange ring connected to one end of said insulation shell, a central bushing conductor extending generally vertically along the axis of said insulation shell and having one end thereof fixed to the other end of said insulation shell; a hollow cylindrical extension secured at one end thereof to said conductive flange ring and being coaxial with said insulation shell; insulator support means mechanically connecting the opposite end of said hollow cylindrical extension to the opposite end of said bushing conductor; said insulator support means being disposed vertically below and being in communication with the interior volume of said insulation shell, whereby contamination particles within said insulation shell can fall onto and coat the surface of said insulator support means facing said interior volume; said hollow cylindrical extension, said conductive grounded housing and at least said one end of said insulation shell having substantially the same diameter; means coaxially connecting said opposite end of said hollow cylindrical extension to one end of said conductive grounded housing and forming a gas-sealed joint therebetween, and means connecting said opposite end of said bushing conductor to said elongated bus conductor; and an internal cylindrical member having one end fixed to and extending from said flange ring and having an outer diameter less than the opposing interior diameter of said insulation shell and less than the interior diameter of said hollow cylindrical extension and telescoping partly into said insulation shell to define a particle trap region.

2. The combination of claim 1 wherein said insulation shell is a porcelain bushing having skirts on the outer surface thereof, and having a conically tapering cross-section.

3. The combination of claim 2 wherein said bushing conductor has a reduced diameter section which extends from said one end thereof to a region adjacent said flange.

4. The combination of claim 1 wherein said insulator support means comprises a conical insulator.

5. In combination, a generally vertically disposed air entrance bushing and a gas-insulated electric power transmission bus;

said gas-insulated bus comprising an elongated, gas-filled conductive grounded housing which is circular in cross-section and which has a given diameter, an elongated central bus conductor, and a plurality of spaced insulator supports supporting said elongated central bus conductor within said housing; at least one end region of said gas-insulated bus being generally vertically disposed, and having one of said plurality of spaced insulator supports disposed near the end of said bus and being generally horizontally disposed across the axis of said housing;

said bushing comprising a generally vertically disposed hollow elongated gas-filled insulation shell, a conductive flange ring having a central opening and which is connected to the bottom end of said insulation shell, a central bushing conductor extending along the axis of said insulation shell and having its upper end thereof fixed to the top end of said insulation shell; said bottom end of said insulation shell having substantially the same diameter as said given diameter of said grounded housing;

the end of said end region of said grounded housing being connected to said conductive flange ring and being coaxial with and extending downwardly from said conductive flange ring; said one of said plurality of spaced insulator supports facing and being in communication with the interior volume of said insulation shell, whereby contamination particles within said insulation shell can fall onto the surface of said one of said plurality of spaced insulator supports which faces upwardly;

the lower end of said central bushing conductor being connected to the end of said central bus conductor at said one end region of said gas-insulated bus;

and an internal conductive cylindrical member for serving as a terminal member for said grounded housing; said internal conductive cylindrical member having one end fixed to and extending from said flange ring at said central opening in said flange ring and extending vertically upwardly and into the interior of said insulation shell; said internal conductive cylindrical member having an outer diameter which is less than the internal diameter of said grounded housing, and which is less than the opposing internal diameter of said insulation shell, whereby the gap between said insulation shell and said internal conductive cylindrical member defines a particle trap region.

6. The combination of claim 5 wherein said conductive flange ring has first and second generally parallel upper and lower surfaces; said insulation shell being connected to said upper surface of said flange ring; said grounded housing being connected to the lower surface of said conductive flange ring.

* * * * *